US005724016A

United States Patent [19]

Roessler et al.

[11] Patent Number: 5,724,016

[45] Date of Patent: Mar. 3, 1998

[54] POWER MAGNETIC DEVICE EMPLOYING A COMPRESSION-MOUNTED LEAD TO A PRINTED CIRCUIT BOARD

[75] Inventors: Robert Joseph Roessler, Rowlett, Tex.; Lennart Daniel Pitzele, Setauket, N.Y.

[73] Assignee: Lucent Technologies Inc., Murray Hill, N.J.

[21] Appl. No.: 791,082

[22] Filed: Jan. 29, 1997

Related U.S. Application Data

[63] Continuation-in-part of Ser. No. 434,485, May 4, 1995.

[51] Int. Cl.[6] ..... H01F 15/10; H01F 27/30

[52] U.S. Cl. ..... 336/65; 336/83; 336/192; 336/200

[58] Field of Search ..... 336/192, 65, 200, 336/232, 83; 29/602.1

[56] References Cited

U.S. PATENT DOCUMENTS

| | | | |
|---|---|---|---|
| Re. 33,541 | 2/1991 | Pryst et al. | 338/226 |
| 3,504,276 | 3/1970 | Proctor et al. | 324/37 |
| 3,965,287 | 6/1976 | Mueller | 174/66 |
| 4,641,114 | 2/1987 | Person | 333/161 |
| 4,672,358 | 6/1987 | Pryst et al. | 338/226 |
| 4,873,757 | 10/1989 | Williams | 29/602.1 |
| 4,975,671 | 12/1990 | Dirks | 336/65 |
| 5,025,305 | 6/1991 | Tomisawa et al. | 357/72 |
| 5,050,038 | 9/1991 | Malaurie et al. | 361/386 |
| 5,055,971 | 10/1991 | Fudala et al. | 361/400 |
| 5,093,774 | 3/1992 | Cobb | 361/306 |
| 5,103,071 | 4/1992 | Henschen et al. | 219/85.22 |
| 5,161,098 | 11/1992 | Balakrishnan | 363/144 |
| 5,179,365 | 1/1993 | Raggi | 336/65 |
| 5,182,536 | 1/1993 | Boylan et al. | 336/65 |
| 5,184,103 | 2/1993 | Gadreau et al. | 336/84 |
| 5,221,212 | 6/1993 | Davis | 439/108 |
| 5,235,311 | 8/1993 | Person et al. | 338/32 R |
| 5,267,218 | 11/1993 | Elbert | 365/226 |
| 5,337,396 | 8/1994 | Chen et al. | 385/92 |
| 5,345,670 | 9/1994 | Pitzele et al. | 29/606 |

FOREIGN PATENT DOCUMENTS

| | | |
|---|---|---|
| 0 267 108 A1 | 5/1988 | European Pat. Off. . |
| 0 608 127 A1 | 1/1994 | European Pat. Off. . |
| 61-075510 | 4/1986 | Japan . |
| 3-78218 (A) | 4/1991 | Japan . |
| 3-183106 | 8/1991 | Japan . |
| 3-283404 (A) | 12/1991 | Japan . |
| 5-82350 (A) | 4/1993 | Japan . |
| 5-135968 (A) | 6/1993 | Japan . |
| 5-59818 | 8/1993 | Japan . |
| 5-291062 (A) | 11/1993 | Japan . |
| 6-163266 (A) | 6/1994 | Japan . |

*Primary Examiner*—Thomas J. Kozma

[57] ABSTRACT

A magnetic device includes: (1) a multi-layer circuit containing a plurality of windings disposed in layers thereof, the multi-layer circuit having inner lateral vias associated therewith, the inner lateral vias intersecting the layers of the multi-layer circuit, (2) a conductive substance disposed within the inner lateral vias and electrically coupling selected ones of the plurality of windings, (3) a magnetic core mounted proximate the plurality of windings and adapted to impart a desired magnetic property to the plurality of windings and (4) a compression-mounted electrical lead resiliently bearing against the conductive substance and electrically coupled to electrical conductors on the substantially planar substrate to conduct electricity therebetween, the plurality of windings and the magnetic core substantially free of a surrounding molding material to allow the magnetic device to assume a smaller overall device volume.

10 Claims, 4 Drawing Sheets

POWER MAGNETIC DEVICE EMPLOYING A COMPRESSION-MOUNTED LEAD TO A PRINTED CIRCUIT BOARD

CROSS-REFERENCE TO RELATED APPLICATIONS

This application is a continuation-in-part of U.S. patent application Ser. No. 08/434,485, entitled "Power Magnetic Device Employing a Leadless Connection to a Printed Circuit Board and Method of Manufacturing Thereof," to Pitzele, et al., filed on May 4, 1995. The above-listed application is commonly assigned with the present invention and is incorporated herein by reference as if reproduced herein in its entirety.

TECHNICAL FIELD OF THE INVENTION

The present invention is directed, in general, to magnetic devices and, more specifically to an inexpensive, readily mass-producible, power magnetic device having a relatively high power density and small footprint that employs a compression-mounted lead to an underlying printed circuit board and method of manufacture thereof.

BACKGROUND OF THE INVENTION

Power magnetic devices, such as inductors and transformers, are employed in many different types of electrical circuits, such as power supply circuits. In practice, most power magnetic devices are fabricated of one or more windings, formed by an electrical member, such as a wire of circular or rectangular cross section, or a planar conductor wound about or mounted to a bobbin composed of dielectric material, such as plastic. In some instances, the electrical member is soldered to terminations on the bobbin. Alternatively, the electrical member may be threaded through the bobbin for connection directly to a metallized area on a circuit board. A magnetic core is typically affixed about the bobbin to impart a greater reactance to the power magnetic device.

As with other types of electronic components, there is a trend in the design of power magnetic devices toward achieving increased power and volumetric density and lower device profile. To achieve higher power, the resistance of the power magnetic device must be reduced, typically by increasing the cross-sectional area of the electrical member forming the device windings, or by simply reducing the electrical path length of the device. To increase the density of the power magnetic device, the bobbin is usually made relatively thin in the region constituting the core of the device to optimize the electrical member resistance. Conversely, the remainder of the bobbin is usually made relatively thick to facilitate attachment of the electrical member to the bobbin terminals or to facilitate attachment of terminals on the bobbin to a circuit board. As a result of the need to make such a bobbin thin in some regions and thick in others, the bobbin is often subject to stresses at transition points between such thick and thin regions.

Another problem associated with present-day power magnetic devices is the lack of co-planarity of the device terminations. Because of the need to optimize the winding thickness of the power magnetic device to provide the requisite number of turns while minimizing the winding resistance, the thickness of the electrical member forming each separate winding of the device is often varied. Variation in the winding thickness often results in a lack of co-planarity of the device terminations, an especially critical deficiency when the device is to be mounted onto a surface of a substrate, such as a printed circuit board ("PCB") or printed wiring board ("PWB").

A surface-mounted power magnetic device is disclosed in U.S. Pat. No. 5,345,670, issued on Sep. 13, 1994, to Pitzele, et al., entitled "Method of Making a Surface Mount Power Magnetic Device," commonly assigned with the present invention and incorporated herein by reference. The power magnetic device of Pitzele, et al. is suitable for attachment to a substrate (such as a PWB) and includes at least one sheet winding having a pair of spaced-apart terminations, each receiving an upwardly rising portion of a lead. The sheet winding terminations and upwardly-rising lead portions, together with at least a portion of the sheet windings, are surrounded by a molding material and encapsulated with a potting material. A magnetic core surrounds at least a portion of the sheet windings to impart a desired magnetic property to the device. Thus, Pitzele, et al., disclose a bobbin-free, encapsulated, surface-mountable power magnetic device that overcomes the deficiencies inherent in, and therefore represents a substantial advance over, the previously-described power magnetic devices. However, several additional opportunities to increase power and volumetric density and lower profile in such power magnetic devices remain.

First, device leads typically extend substantially from the device footprint and therefore increase the area of the substrate required to mount the device. In fact, extended leads can add 30% to the footprint or 50% to the volume of the magnetic device. Second, termination co-planarity requires either the aforementioned devices be molded in a lead frame (requiring additional tooling and tighter tolerances) or the leads be staked in after molding (requiring an additional manufacturing operation). Third, the outer molding compound employed for electrical isolation and thermal conductivity adds both volume and cost and raises device profile.

Accordingly, what is needed in the art is a power magnetic device having an improved termination or lead structure and a structure that attains an acceptable electrical isolation and thermal conductivity without requiring a molding compound. Further, what is needed in the art is a method of manufacture for such devices.

SUMMARY OF THE INVENTION

To address the above-discussed deficiencies of the prior art, the present invention provides a magnetic device, including: (1) a multi-layer circuit containing a plurality of windings disposed in layers thereof, the multi-layer circuit having inner lateral vias associated therewith, the inner lateral vias intersecting the layers of the multi-layer circuit, (2) a conductive substance disposed within the inner lateral vias and electrically coupling selected ones of the plurality of windings, (3) a magnetic core mounted proximate the plurality of windings and adapted to impart a desired magnetic property to the plurality of windings and (4) a compression-mounted electrical lead (e.g., solder-laden compression-mounted electrical lead) resiliently bearing against the conductive substance and electrically coupled to electrical conductors on the substantially planar substrate to conduct electricity therebetween, the plurality of windings and the magnetic core substantially free of a surrounding molding material to allow the magnetic device to assume a smaller overall device volume.

The present invention therefore introduces the concept of using a compression-type electrical lead in an unencapsulated magnetic device that uses via-coupled multi-layer windings. The windings are laid-up in the form of a multi-layer circuit. The lead is designed to bear upon the vias to allow conduction of electrical currents between the leads and the conductive substance in the vias.

In one embodiment of the present invention, the substantially planar substrate has a window defined therein, the magnetic core at least partially recessed within the window thereby to allow the magnetic device to assume a lower profile. In the embodiment to be described, the magnetic core advantageously recesses into the substrate, although this need not be the case in the broad scope of the present invention.

In one embodiment of the present invention, a solder at least partially fills the inner lateral vias to allow the inner lateral vias to act as conductors between the plurality of windings and the electrical conductors on the substantially planar substrate. The conductive substance may therefore take the form of a solder that has been melted within the vias.

In one embodiment of the present invention, the multi-layer circuit comprises outer lateral vias located therethrough and intersecting the layers of the multi-layer circuit, a conductor disposed within the outer lateral vias further electrically coupling the selected ones of the plurality of windings. The present invention employs the vias as interconnects between the layers of windings. Therefore, vias may be added, deleted or rearranged as necessary, depending upon current-handling requirements, mounting considerations and the like.

In one embodiment of the present invention, the compression-mounted electrical lead is a clamp. The broad scope of the present invention does not limit the type of compression-mounted electrical lead employed.

In one embodiment of the present invention, the magnetic core surrounds and passes through a central aperture in the plurality of windings. In alternative embodiments, the core can simply surround the windings.

In one embodiment of the present invention, the device further comprises a plurality of inner lateral vias formed on opposing ends of the multi-layer circuit. This allows the leads to extend from both of the opposing ends of the multi-layer circuit, resulting in an arrangement approximating a dual in-line package ("DIP").

In one embodiment of the present invention, the plurality of windings form primary and secondary windings of a power transformer. The plurality of windings may form a two-terminal device, such as an inductor.

In one embodiment of the present invention, the magnetic device forms a portion of a power supply. Those skilled in the art will perceive many applications for the fundamental structure the present invention introduces.

In one embodiment of the present invention, the magnetic core comprises first and second core-halves. Alternatively, the core may be unitary or may comprise more than two pieces.

The foregoing has outlined rather broadly preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
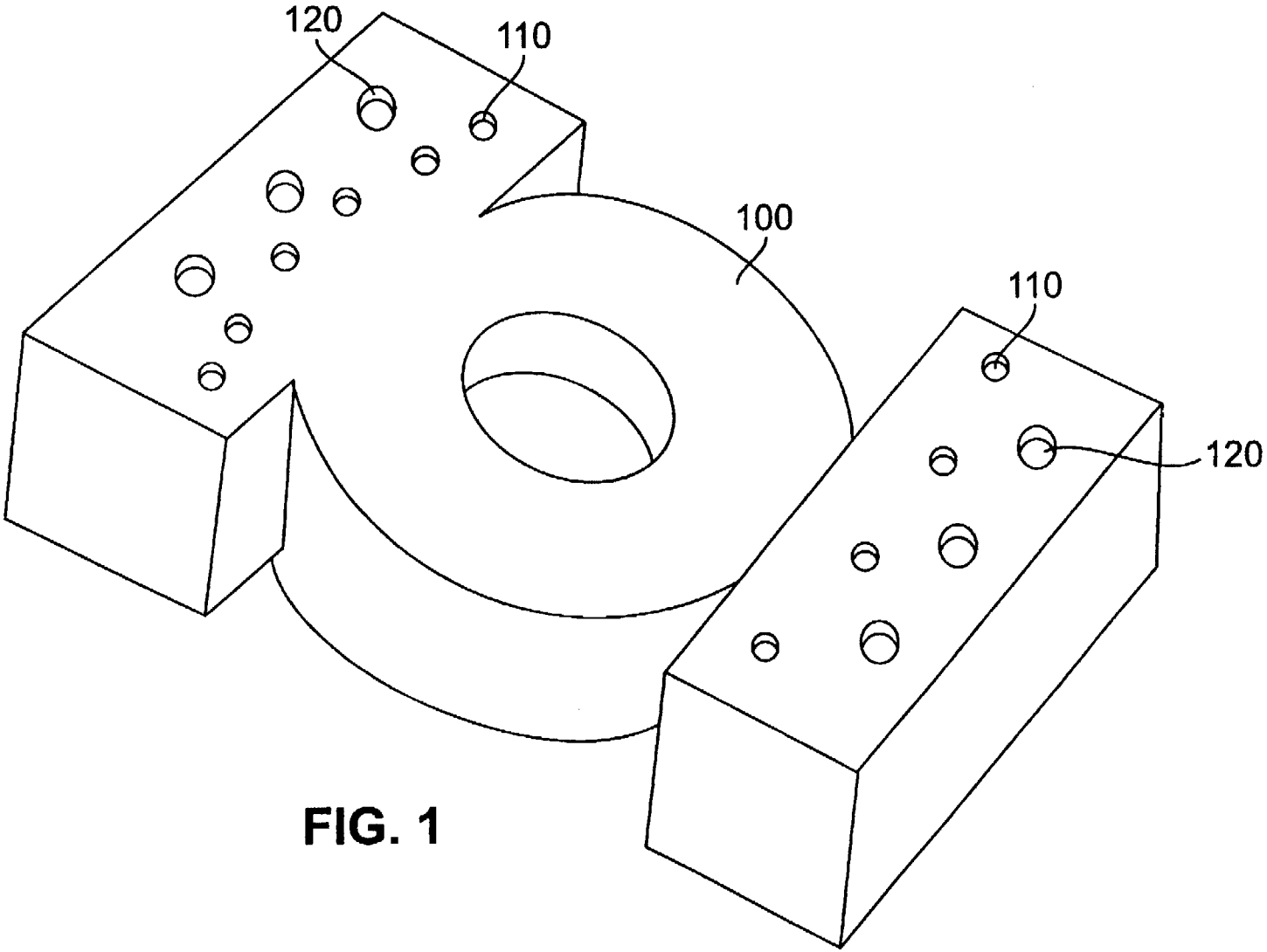
FIG. 1 illustrates an isometric view of the multi-layer circuit of the present invention.

Referring initially to FIG. 1, illustrated is an isometric view of the multi-layer circuit or multi-layer circuit 100 of the present invention. The multi-layer circuit 100 contains a plurality of windings (not shown) disposed in layers thereof. The plurality of windings can be of the same or different thicknesses and the number of windings may vary therein. Typically, the plurality of windings form primary and secondary windings of a power transformer. However, the plurality of windings can form windings of an inductor or other device.

The multi-layer circuit 100 includes a plurality of inner lateral vias 110 and a plurality of outer lateral vias 120 located therethrough. While FIG. 1 illustrates a plurality of inner and outer lateral vias 110, 120, it is appreciated that a single inner and outer via 110, 120, or a single inner via 110, or a single outer via 120 is within the scope of the present invention. The inner and outer lateral vias 110, 120 intersect the layers of the multi-layer circuit 100. A conductive substance (not shown) is deposited within the lateral vias 110, 120 electrically coupling the plurality of windings located in the multi-layer circuit 100. The process of electrically coupling the plurality of windings as described is generally known in the industry as reinforced plating.

Figure 2:
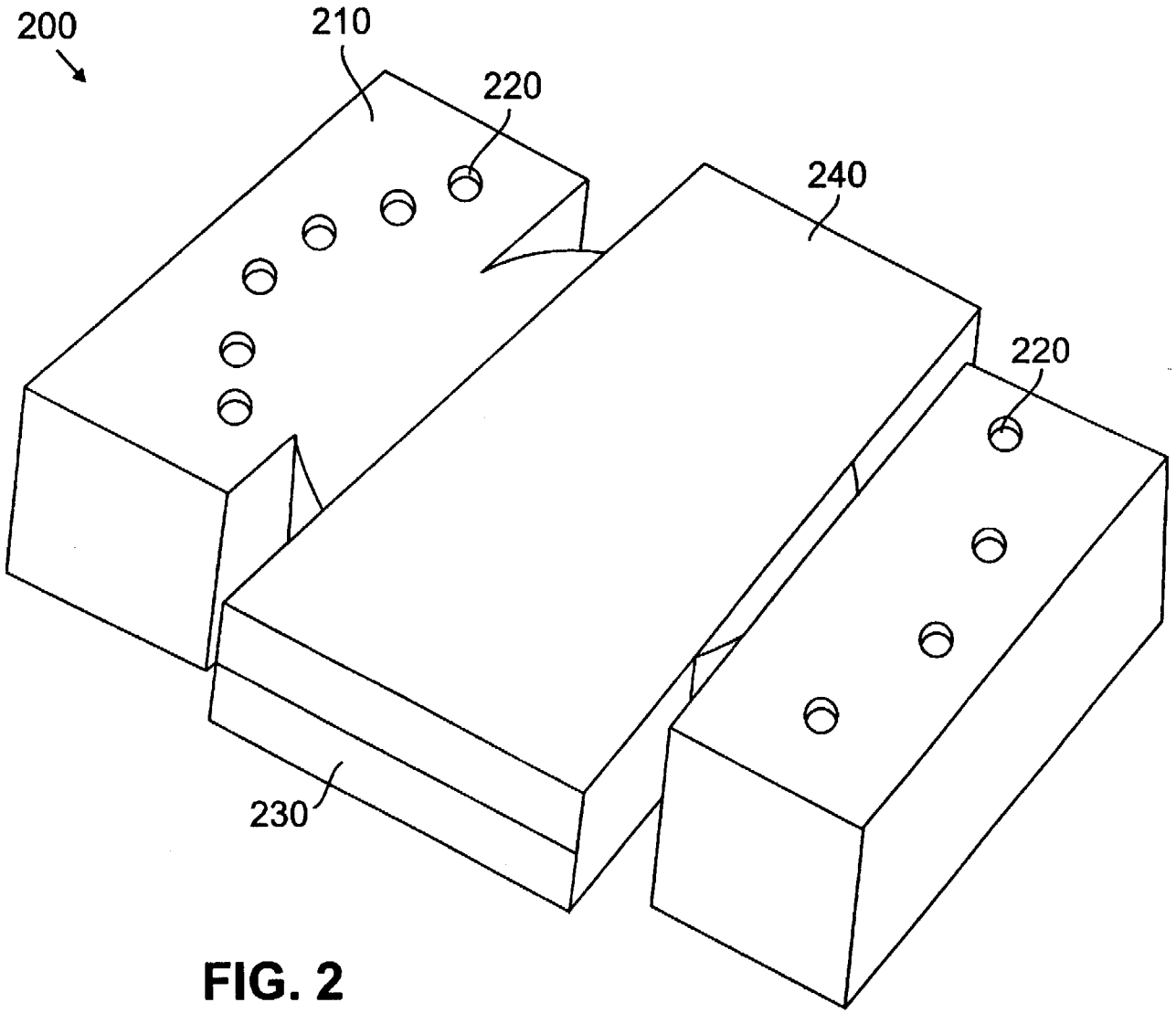
FIG. 2 illustrates an isometric view of a magnetic device of the present invention.

Turning now to FIG. 2, illustrated is an isometric view of a magnetic device or device 200 of the present invention. The device 200 includes a multi-layer circuit 210 having a plurality of inner lateral vias 220 with a conductive substance (not shown) disposed therein to electrically couple selected ones of a plurality of windings (not shown) making up the multi-layer circuit 210.

A magnetic core, having a first core half 230 and a second core half 240, surrounds and passes through a substantially central aperture of the multi-layer circuit 210. Alternatively, the magnetic core may be of unitary construction. The magnetic core is typically fabricated out of a ferromagnetic material, although other materials with magnetic properties are also within the scope of the present invention. The magnetic core imparts a desired magnetic property to the multi-layer circuit 210. The multi-layer circuit 210 and the first and second core halves 230, 240 are substantially free of a surrounding molding material to allow the device 200 to assume a smaller overall device volume and elevational profile.

Figure 3:
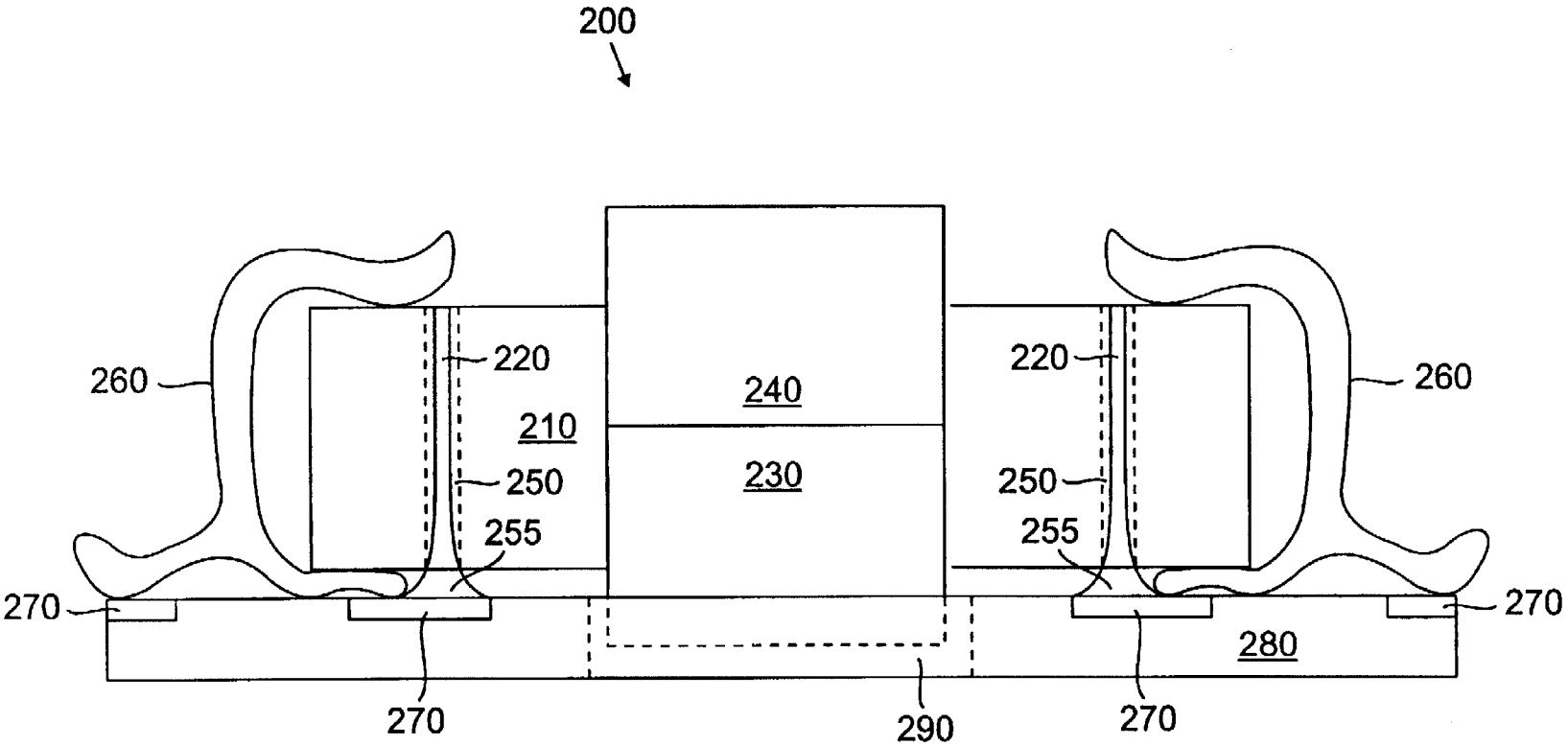
FIG. 3 illustrates an elevational view of the magnetic device of FIG. 2.

Turning now to FIG. 3, illustrated is an elevational view of the device 200 of FIG. 2. The device 200, including the multi-layer circuit 210 (with the inner lateral vias 220) and the first and second core halves 230, 240, advantageously form a portion of a power supply (not shown). The conductive substance (e.g., a solder) 250 is disposed within the inner lateral vias 220 to electrically couple selected ones of the plurality of windings of the multi-layer circuit 220. The device 200 also includes compression-mounted electrical leads (e.g., a clamp, such as a solder inlay lead frame, manufactured by Proner Comatel U.S.A., Inc. of Danbury, Conn.) 260 resiliently bearing against the conductive substance 250 and electrically coupled to electrical conductors 270 on a substantially planar substrate 280 to conduct electricity therebetween. The plurality of windings and the magnetic core are substantially free of a surrounding molding material to allow the device 200 to assume a smaller overall device volume. The planar substrate 280 is typically a printed circuit board ("PCB") or printed circuit board ("PWB").

A window 290 is defined within the planar substrate 280. The window 290 provides a recess for the first or second core halves 230, 240 thereby allowing the device 200 to assume an even lower profile.

In the present embodiment, a plurality of solder connections are created between the planar substrate 280 and the inner lateral vias 220. The solder connections, in combination with the compression-mounted electrical leads 260, secure the device 200 to the planar substrate 280 and act as conductors between a plurality of windings of the multi-layer circuit 210 and electrical conductors 270 on the planar substrate 280.

Now referring to FIGS. 2 and 3, a method for manufacturing the device 200 embodying the present invention will be described in greater detail. The process commences with manufacturing the multi-layer circuit 210. The multi-layer circuit 100 is cut, establishing the inner lateral vias 220. The inner lateral vias 220 intersect the layers of the multi-layer circuit 210. The conductive substance 250 is deposited within the inner lateral vias 220 to electrically couple the plurality of windings. The inner lateral vias 220 also provide a conductive path between the plurality of windings.

After the multi-layer circuit 210, with the inner lateral vias 220, is prepared, an epoxy adhesive is then applied to the first core half 230 and the first and second core halves 230, 240 are rung together around a central portion of the multi-layer circuit 210. The magnetic core is twisted to ring the adhesive and create a very minute interfacial bond line between the first and second core halves 230, 240. The magnetic core is adapted to impart a desired magnetic property to the multi-layer circuit 210. The compression-mounted electrical leads 260 are then coupled to the multi-layer circuit 210 and resiliently bear against the conductive substance 250.

The device 200 is then mounted on the planar substrate 280. The mounting procedure commences by depositing solder paste at a plurality of terminal sites on the planar substrate 280. The device 200 is then placed on the planar substrate 280 at the terminal sites. The planar substrate 280 is provided with a substantially rectangular portion removed to create a window 290 in the planar substrate 280 that matches the outline of the magnetic core. The compression-mounted electrical leads 260 resiliently bear against the conductive substance 250 and are further electrically coupled to the electrical conductors 270 on the planar substrate 280 to conduct electricity therebetween. Solder is then applied to the inner lateral vias 220. A solder reflow process is then performed. The solder reflow process firmly establishes solder connections 255 to further secure the device 200 to the planar substrate 280.

The method of manufacture of the present invention reduces material and assembly costs by simplifying the solder processes, and eliminating molding and termination operations. This method also addresses and solves the co-planarity and dimensional issues associated with surface mount components by eliminating the need for a bobbin or header, by foregoing a molding compound, and by recessing the magnetic core in the window 290 of the planar substrate 280. Finally, the method can be highly automated with the only hand labor involved being in the traditional magnetic core assembly process.

Figure 4:
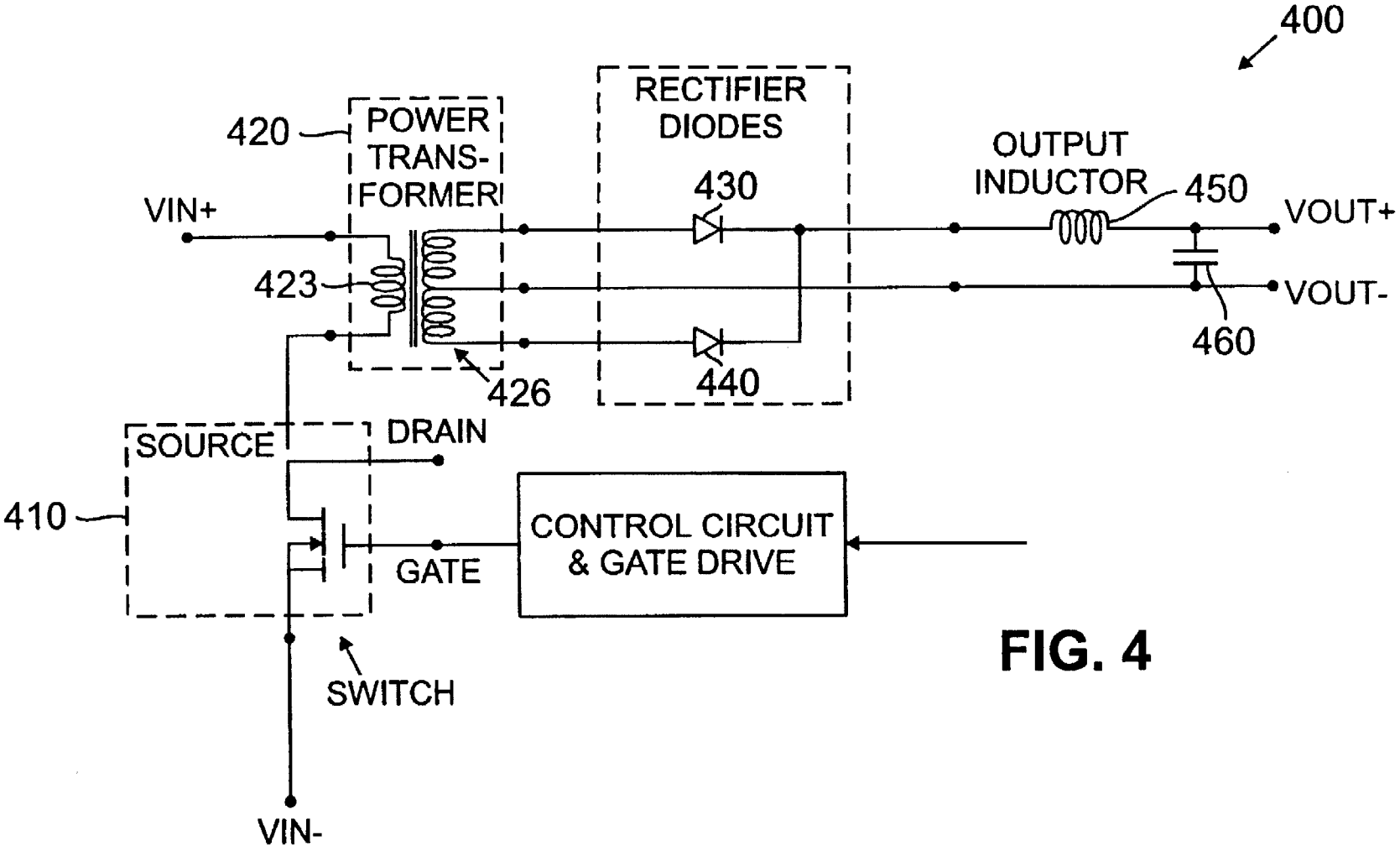
FIG. 4 illustrates a schematic diagram of a power supply employing the magnetic device of FIG. 2.

Turning now to FIG. 4, illustrated is a schematic diagram of a power supply 400 employing the magnetic device 420 of the present invention. The power supply 400 includes a power train having a conversion stage including a power switching device 410 for receiving input electrical power $V_{IN}$ and producing therefrom switched electrical power. The power supply 400 further includes a filter stage (including an output inductor 450 and output capacitor 460) for filtering the switched electrical power to produce output electrical power (represented as a voltage $V_{OUT}$). The power supply 400 still further includes the transformer 420, having a primary winding 423 and a secondary winding 426) and a rectification stage (including rectifying diodes 420, 430) coupled between the power conversion stage and the filter stage. The transformer 420 is constructed according to the principles of the present invention as previously described.

For a better understanding of power electronics including power supplies and conversion technologies see "Principles of Power Electronics," by J. G. Kassakian, M. F. Schlecht and G. C. Verghese, Addison-Wesley (1991). For a better understanding of magnetic devices and construction techniques therefor see "Printed Circuits Handbook," by Clyde Coombs, Jr., McGraw Hill Book Co., 4th Edition (1995). The aforementioned references are herein incorporated by reference.

Although the present invention has been described in detail, those skilled in the art should understand that they can make various changes, substitutions and alterations herein without departing from the spirit and scope of the invention in its broadest form.

What is claimed is:

1. A magnetic device, comprising:

a multi-layer circuit containing a plurality of windings disposed in layers thereof, said multi-layer circuit having inner lateral vias associated therewith, said inner lateral vias intersecting said layers of said multi-layer circuit;

a conductive substance disposed within said inner lateral vias and electrically coupling selected ones of said plurality of windings;

a magnetic core mounted proximate said plurality of windings and adapted to impart a desired magnetic property to said plurality of windings; and a compression-mounted electrical lead resiliently bearing against said conductive substance and electrically coupled to electrical conductors on a substantially planar substrate to conduct electricity therebetween, said plurality of windings and said magnetic core substantially free of a surrounding molding material to allow said magnetic device to assume a smaller overall device volume.

2. The device as recited in claim 1 wherein said substantially planar substrate has a window defined therein, said magnetic core at least partially recessed within said window thereby to allow said magnetic device to assume a lower profile.

3. The device as recited in claim 1 wherein a solder at least partially fills said inner lateral vias to allow said inner lateral vias to act as conductors between said plurality of windings and said electrical conductors on said substantially planar substrate.

4. The device as recited in claim 1 wherein said multi-layer circuit comprises outer lateral vias located therethrough and intersecting said layers of said multi-layer circuit, a conductor disposed within said outer lateral vias further electrically coupling said selected ones of said plurality of windings.

5. The device as recited in claim 1 wherein said compression-mounted electrical lead is a clamp.

6. The device as recited in claim 1 wherein said magnetic core surrounds and passes through a central aperture in said plurality of windings.

7. The device as recited in claim 1 further comprising a plurality of inner lateral vias formed on opposing ends of said multi-layer circuit.

8. The device as recited in claim 1 wherein said plurality of windings form primary and secondary windings of a power transformer.

9. The device as recited in claim 1 wherein said magnetic device forms a portion of a power supply.

10. The device as recited in claim 1 wherein said magnetic core comprises first and second core-halves.

* * * * *